US006872235B2

(12) United States Patent
Johansson

(10) Patent No.: US 6,872,235 B2
(45) Date of Patent: Mar. 29, 2005

(54) IRON POWDER COMPOSITION

(75) Inventor: Björn Johansson, Höganäs (SE)

(73) Assignee: Höganäs AB, Höganäs (SE)

( * ) Notice: Subject to any disclaimer, the term of this patent is extended or adjusted under 35 U.S.C. 154(b) by 68 days.

(21) Appl. No.: 10/201,954

(22) Filed: Jul. 25, 2002

(65) Prior Publication Data

US 2003/0075017 A1 Apr. 24, 2003

Related U.S. Application Data

(63) Continuation-in-part of application No. 09/852,016, filed on May 10, 2001, now abandoned, which is a continuation of application No. PCT/SE02/00763, filed on Apr. 17, 2002.

(30) Foreign Application Priority Data

Apr. 17, 2001 (SE) ..... 0101343

(51) Int. Cl.[7] ..... B22F 1/00

(52) U.S. Cl. ..... 75/252; 419/36; 508/103; 508/151; 508/454

(58) Field of Search ..... 75/252, 231, 246; 419/36; 508/103, 151, 454, 551

(56) References Cited

U.S. PATENT DOCUMENTS 3,960,984 A * 6/1976 Kohan ..... 525/400
4,955,798 A 9/1990 Musella et al.
5,154,881 A 10/1992 Rutz et al.
5,368,630 A 11/1994 Luk
5,476,534 A 12/1995 Ogura et al.
5,744,433 A 4/1998 Storström et al.
5,754,936 A * 5/1998 Jansson ..... 419/10
5,782,954 A 7/1998 Luk
5,926,686 A 7/1999 Engström et al.
5,976,215 A 11/1999 Uenosono et al.
6,511,945 B1 * 1/2003 Ramstedt ..... 508/151

FOREIGN PATENT DOCUMENTS

JP 4136104 8/1992
WO WO 02/083346 10/2002

* cited by examiner

*Primary Examiner*—Ngoclan T. Mai
(74) *Attorney, Agent, or Firm*—Burns, Doane, Swecker & Mathis, LLP

(57) ABSTRACT

The invention concerns a method of preparing an iron-based powder comprising the steps of mixing and heating an iron-based powder, at least one oligomer amide type lubricant, at least one fatty acid and optionally one or more additives to a temperature above the melting point of the lubricant and subsequently cooling the obtained mixture. The invention also comprises the mixture of the iron-based powder, the oligomer amide type lubricant and the fatty acid.

16 Claims, 2 Drawing Sheets

IRON POWDER COMPOSITION

This is a continuation-in-part of U.S. patent application Ser. No. 09/852,016, filed May 10, 2001 now abandoned; is a continuation of International Application No. PCT/SE02/00763 that designates the United States of America which was filed on Apr. 17, 2002 and was published in English on Oct. 24, 2002; and claims priority for Swedish Application No. 0101343-2, filed on Apr. 17, 2001.

FIELD OF THE INVENTION

The present invention relates to metal powder compositions and a method of preparing such compositions. Particularly the invention relates to iron-based compositions having consistent apparent density and flowability at different temperatures.

BACKGROUND OF THE INVENTION

The powder metallurgy art generally uses different standard temperature regimes for the compaction of a metal powder to form a metal component. These include chill-pressing (pressing below ambient temperatures), cold-pressing (pressing at ambient temperatures), hot-pressing (pressing at temperatures above those at which the metal powder is capable of retaining work-hardening), and warm-pressing (pressing at temperatures between cold-pressing and hot-pressing).

Distinct advantages arise by pressing at temperatures above ambient temperature. The tensile strength and work hardening rate of most metals is reduced with increasing temperatures, and improved density and strength can be attained at lower compaction pressures. The extremely elevated temperatures of hot-pressing, however, introduce processing problems and accelerate wear of the dies. Therefore, current efforts are being directed towards the development of metal compositions suitable for warm-pressing processes.

The U.S. Pat. No. 4,955,798 (Musella) describes warm compaction in general. According to this patent, lubricants generally used for cold compaction, e.g. zinc stearate, can be used for warm compaction as well. In practice, however, it has proved impossible to use zinc stearate or ethylene bisstearamide (commercially available as ACRA WAX®.), which at present are the lubricants most frequently used for cold compaction, for warm compaction. The problems, which arise, are due to difficulties in filling the die in a satisfactory manner.

The U.S. Pat. Nos. 5,744,433 (Storstrom et al) and 5,154,881 (Rutz) disclose metal powder compositions including amide lubricants which are especially developed for warm compaction. The U.S. Pat. No. 5,744, 433 discloses a lubricant for metallurgical powder compositions contains an oligomer of amide type, which has a weight-average molecular weight $M_w$ of 30,000 at the most. In the U.S. Pat. No. 5,154,881 the amide lubricant consists of the reaction product of a monocarboxylic acid, a dicarboxylic acid and a diamine. Especially preferred as a lubricant is ADVAWAX.®. 450, which is an ethylenebisstearamide product.

Although the lubricants disclosed in these two patents are especially developed for warm compaction and work well in many cases it has been found that different problems are encountered when these lubricants are used in metal compositions intended for large scale production of sintered components.

OBJECTS OF THE INVENTION

An object of the present invention is to reduce or eliminate current problems associated with large scale production.

Another object is to provide a new type of lubricant useful in metal compositions intended for compaction at elevated temperatures.

Still another problem is to provide an iron-based powder composition distinguished by excellent flow rate and apparent density.

A further object is to provide a powder composition, which generates a minimum of dust and the preparation of which does not require the use of organic solvents.

Another object is to provide a method for warm compaction such a metal powder composition.

SUMMARY OF THE INVENTION

These objects are achieved by a powder composition comprising an iron-based powder, at least one oligomer amide type lubricant, at least one fatty acid and optionally one or more additives such as flow agents, processing aids and hard phases.

The method according to the invention includes the steps of mixing and heating the iron-based powder, the lubricant, the fatty acid and the additive, if any, to a temperature above the melting point of the lubricant and cooling the obtained mixture.

DETAILED DESCRIPTION OF THE INVENTION

As used in the description and the appended claims, the expression "iron-based powder" encompasses powder essentially made up of pure iron; iron powder that has been prealloyed with other substances improving the strength, the hardening properties, the electromagnetic properties or other desirable properties of the end products; and particles of iron mixed with particles of such alloying elements (diffusion annealed mixture or purely mechanical mixture). Examples of alloying elements are nickel, copper, molybdenum, chromium, manganese, phosphorus, carbon in the form of graphite, and tungsten, which are used either separately or in combination, e.g. in the form of compounds ($Fe_3$ P and FeMo). Unexpectedly good results are obtained when the lubricants according to the invention are used in combination with iron-based powders having high compressability. Generally, such powders have a low carbon content, preferably below 0.04% by weight. Such powders include e.g. Distaloy AE, Astaloy Mo and ASC 100.29, all of which are commercially available from Hoganas AB, Sweden.

The lubricant used according to the present invention is new and may be represented by the following formula:

$$D\text{-}C_{ma}\text{-}B\text{-}A\text{-}B\text{-}C_{mb}\text{-}D$$

wherein D is —H, COR, CNHR, wherein R is a straight or branched aliphatic or aromatic group including 2–21 C atoms C is the group —NH $(CH)_n$CO—

B is amino or carbonyl

A is alkylen having 4–16 C atoms optionally including up to 4 O atoms ma is an integer 1–10 mb is an integer 1–10 n is an integer 5–11.

Preferably the lubricant has the chemical structure wherein D is COR, wherein R is an aliphatic group 16–20 C atoms, C is —NH $(CH)_n$CO— wherein n is 5 or 11; B is amino; A is alkylen having 6–14 C atoms optionally including up to 3 O atoms, and ma and mb, which may be the same or different is an integer 2–5.

Examples of such lubricants may be selected from the group consisting of $CH_3(CH_2)_{16}CO—[HN(CH_2)_{11}CO]_2—HN(CH_2)_{12}NH—[OC(CH_2)_{11}NH]_2—OC(CH_2)_{16}CH_3$ $CH_3(CH_2)_{16}CO—[HN(CH_2)_{11}CO]_2—HN(CH_2)_{12}NH—[OC(CH_2)_{11}NH]_3—OC(CH_2)_{16}CH_3$ $CH_3(CH_2)_{16}CO—[HN(CH_2)_{11}CO]_3—HN(CH_2)_{12}NH—[OC(CH_2)_{11}NH]_3—OCCH_2)_{16}CH_3$ $CH_3(CH_2)_{16}CO—[HN(CH_2)_{11}CO]_3—HN(CH_2)_{12}NH—[OC(CH_2)_{11}NH]_4—OC(CH_2)_{16}CH_3$ $CH_3(CH_2)_{16}CO—[HN(CH_2)_{11}CO]_4—HN(CH_2)_{12}NH—[OC(CH_2)_{11}NH]_4—OC(CH_2)_{16}CH_3$ $CH_3(CH_2)_{16}CO—[HN(CH_2)_{11}CO]_4—HN(CH_2)_{12}NH—[OC(CH_2)_{11}NH]_5—OC(CH_2)_{16}CH_3$ $CH_3(CH_2)_{16}CO—[HN(CH_2)_{11}CO]_5—HN(CH_2)_{12}NH—[OC(CH_2)_{11}NH]_5—OC(CH_2)_{16}CH_3$ Other examples are $CH_3)CO—HN(CH_2)_5CO—HN(CH_2)_2NH—OC(CH_2)_5NH—OC(CH_3)$ having the MW 370.49;

$CH_3(CH_2)_20CO—HN(CH_2)_{11}CO—HN(CH_2)_{12}NH—OC(CH_2)_{11}NH—OC(CH_2)_{20}CH_3$ having the MW 1240.10

$CH_3(CH_2)_{20}CO—[HN(CH_2)_{11}CO]_{10}—HN(CH_2)_{12}NH—[OC(CH_2)_{11}NH]_{10}—OC(CH_2)_{20}CH_3$ having the MW 8738.04

$CH_3(CH_2)_4CO—[HN(CH_2)_{11}CO]_3—HN(CH_2)_{12}NH—[OC(CH_2)_{11}NH]_3—OC(CH_2)_4CH_3$ having the MW 1580.53

$CH_3(CH_2)_4CO—[HN(CH_2)_5CO]_7—HN(CH_2)_6NH—[OC(CH_2)_5NH]_7—OC(CH_2)_4CH_3$ having the MW 1980.86

$CH_3(CH_2)_{20}CO—[HN(CH_2)_5CO]_7—HN(CH_2)_6NH—[OC(CH_2)_5NH]_7—OC(CH_2)_{20}CH_3$ having the MW 2429.69 and $CH_3(CH_2)_{16}NH—[OC(CH_2)_{11}NH]_4—CO(CH_2)_{10}CO—[HN(CH_2)_{11}CO]_4—HN(CH_2)_{16}CH_3$ having the MW 2283.73

The oligomer amide type lubricant, which is added to the iron-based powder is preferably in the form of a solid powder, can make up 0.1–1% by weight of the metal-powder composition, preferably 0.2–0.8% by weight, based on the total amount of the metal-powder composition. The possibility of using the lubricant according to the present invention in low amounts is an especially advantageous feature of the invention, since it enables high densities to be achieved The fatty acid used according to the present inventions is preferably a fatty acid having 10–22 C atoms. Examples of such acids are oleic acid, stearic acid and palmitic acid. Although the amount of the fatty acid is small, the effects on flow rate and apparent density are remarkable. The amount of the fatty acid is normally 0.005–0.15, preferably 0.010–0.08 and most preferably 0.015–0.07% calculated on the total weight of the powder composition. Fatty acid contents below 0.005 make it difficult to achieve an even distribution of the fatty acid. If the content is higher than 0.15 there is a considerable risk that the flow will deteriorate.

The melting point of the fatty acid should be lower than that of the amide oligomer lubricant.

Apart from the iron-based powder and the lubricant, the new powder composition may contain one or more additives selected from the group consisting of processing aids and hard phases.

The processing aids used in the metal-powder composition may consist of talc, forsterite, manganese sulphide, sulphur, molybdenum disulphide, boron nitride, tellurium, selenium, barium difluoride and calcium difluoride, which are used either separately or in combination.

The hard phases used in the metal-powder composition may consist of carbides of tungsten, vanadium, titanium, niobium, chromium, molybdenum, tantalum and zirconium, nitrides of aluminium, titanium, vanadium, molybdenum and chromium, $Al_2O_3$, and various ceramic materials.

A type of flow agent, which can be used according to the present invention, is disclosed in the U.S. Pat. No. 5,782,954 (which is hereby incorporated by reference). The flow agent, which is preferably a silicon dioxide, is used in an amount from about 0.005 to about 2 percent by weight, preferably from about 0.01 to about 1 percent by weight, and more preferably from about 0.025 to about 0.5 percent by weight, based on the total weight of the metallurgical composition. Furthermore, the flow agent should have an average particle size below about 40 nanometers. Preferred silicon oxides are the silicon dioxide materials, both hydrophilic and hydrophobic forms, commercially available as the Aerosil line of silicon dioxides, such as the Aerosil 200 and R812 products, from Degussa Corporation.

According to an embodiment of the invention the iron-based powder, at least one oligomer amide type lubricant, at least one fatty acid and optionally one or more additives, such as processing aids and hard phases, are heated to a temperature above the melting point of the lubricant; the obtained mixture is subsequently cooled to a temperature below the melting point of the lubricant and above the melting point of the fatty acid; and a pulverulent flow agent is added to the obtained mixture, which is then mixed and cooled.

The powder mixture tested was prepared by dry mixing Distaloy AE (an iron-based powder available from Höganäs AB, Sweden) with 0.6% by weight of organic material which consisted of the oligomer amide type lubricant defined above and 0.03 or 0.05% by weight of stearic acid. 0.3% by weight of graphite was aslo added and the obtained mixture was heated to 165° C. The mixture was cooled to 110° C. and 0.06% by weight of Aerosil® was added at this temperature. Essentially the same results are obtained when the Aerosil is added at ambient temperature.

Figure 1:
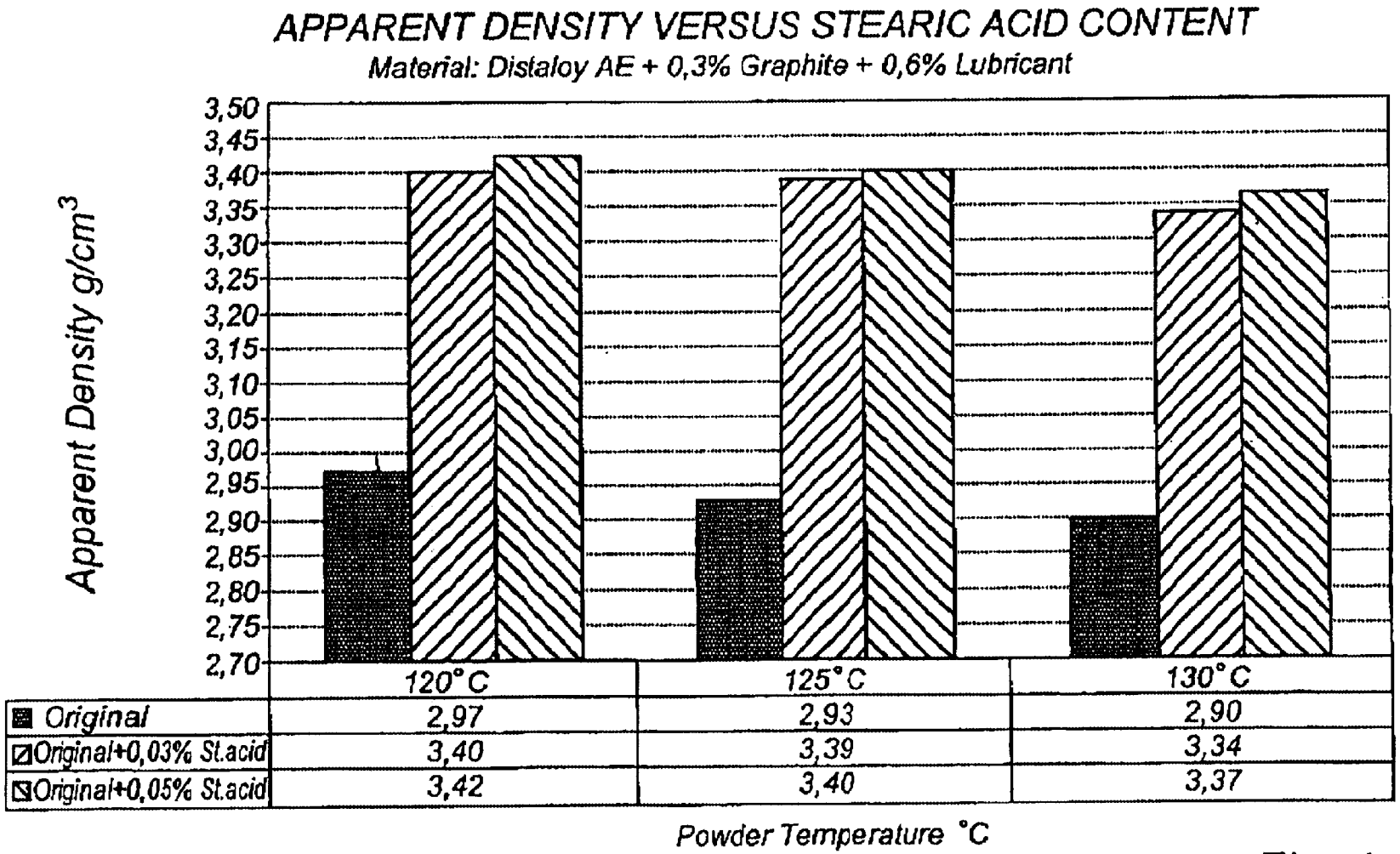
FIG. 1 shows the effect of the combination of the oligomer amide type lubricant defined above and a fatty acid (stearic acid) on the apparent density.
Figure 2:
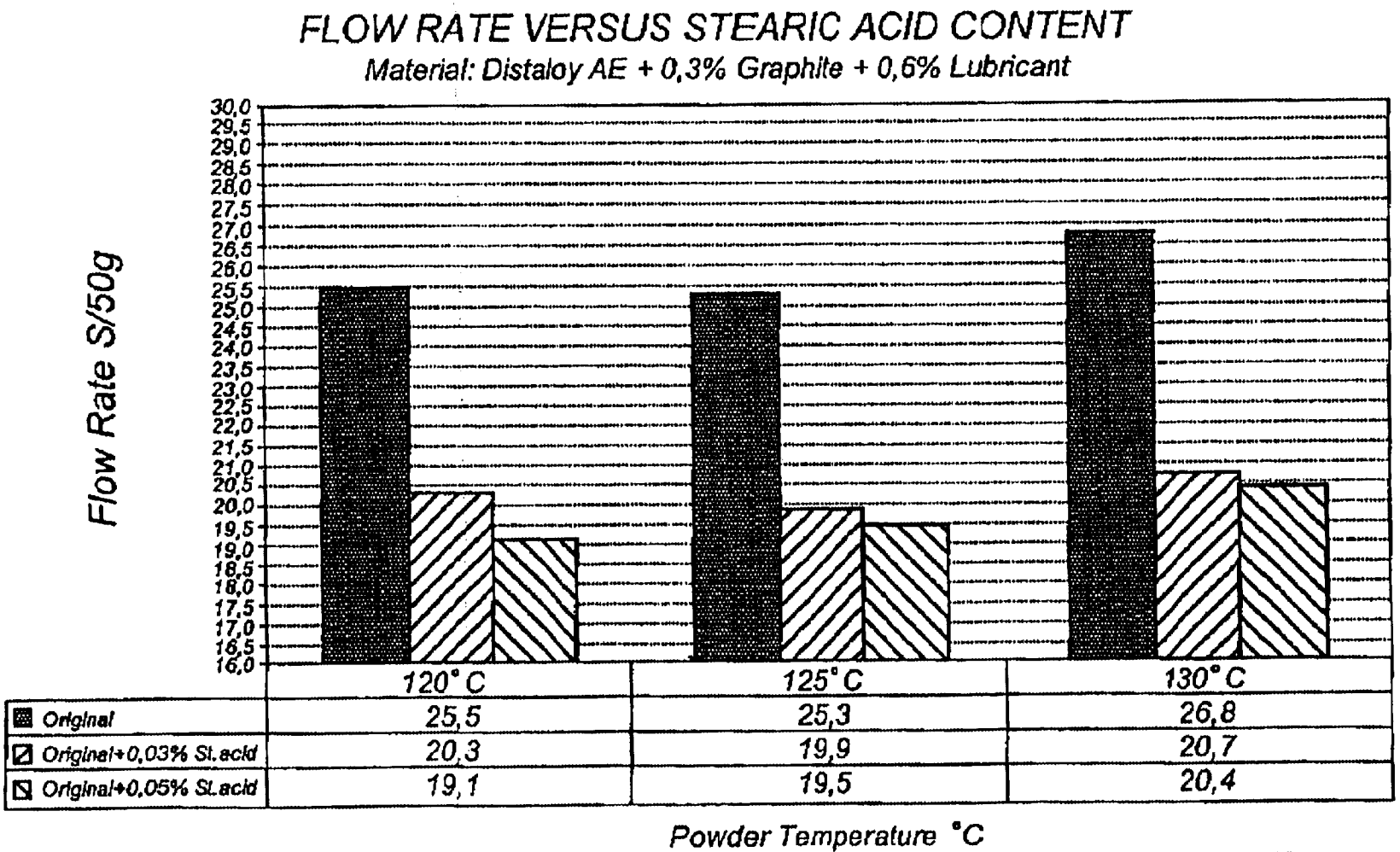
FIG. 2 shows the effect of the combination of the lubricant defined above and a fatty acid (stearic acid) on the flow rate.

The results disclosed in FIGS. 1 and 2 respectively demonstrate that clear and unexpected effects on both apparent density and flow can be obtained with the powder compositions according to the present invention.

The above mixture which included 0.03% by weight of stearic acid was also tested with regard to the dust reduction in comparison with a mixture prepared according to the U.S. Pat. No. 5,368,630. The known mixture also included 0.6% by weight of organic material but in this case the organic material consisted of 0.55% by weight of lubricant and 0.15% by weight of an organic binder (cellulose butyrate). The iron-based powder was Distaloy AE in both mixtures. The preparation of the known mixture involves dry mixing of the iron-based powder, the lubricant according to the US patent and 0.3% by weight of graphite. The organic binder was dissolved in acetone and added to the dry mixture and after thorough mixing. The acetone was removed and 0.06% by weight of Aerosil® was added to the dried mixture.

In the following table results from the tests are summarised:

| SAMPLE | DUSTING ($mg/m^3 \cdot min \cdot g[mix]$) |
|---|---|
| Mixture according to the present invention | 41 |

-continued

| SAMPLE | DUSTING ($mg/m^3 \cdot min \cdot g[mix]$) |
|---|---|
| Mixture according to the U.S. Pat. No. 5,368,630 | 70 |

What is claimed is:

1. A powder composition comprising an iron-based powder, at least one oligomer amide lubricant represented by the following formula:

$$D\text{-}C_{ma}\text{-}B\text{-}A\text{-}B\text{-}C_{mb}D,$$

wherein D is —H, COR, CNHR, wherein R is a straight or branched aliphatic or aromatic group including 2–21 C atoms, C is the group —NH $(CH)_n$CO—, B is the amino or carbonyl, A is alkylene having 4–16 C atoms optionally including up to 4 O atoms, ma is an integer 1–10, mb is an integer 1–10, n is an integer 5–11, and a fatty acid having 10–22 C and a melting point lower than the oligomer amide lubricant.

2. Composition according to claim 1, wherein the fatty acid is selected from the group consisting of oleic acid, stearic acid, palmitic acid, and combinations thereof.

3. Composition according to claim 1, wherein the lubricant has the chemical structure wherein D is COR, wherein R is an aliphatic group having 16–20 C atoms, C is —NH $(CH)_n$CO— wherein n is 5 or 11; B is amino; A is alkylene having 6–14 C atoms optionally including up to 3 O atoms, and m is an integer 2–5.

4. Composition according to claim 1, wherein the amount of the fatty acid is 0.015–0.15% calculated on the total weight of the powder composition.

5. Composition according to claim 1, wherein the composition includes one or more additives selected from the group consisting of binders, flow agents, processing aids and hard phases.

6. Composition according to claim 1, wherein a flow agent is included in an amount from about 0.005 to about 2 percent by weight based on the total weight of the metallurgical composition and has an average particle size below about 40 nanometers.

7. Composition according to claim 6, wherein the flow agent is a silicon dioxide.

8. Method of preparing an iron-based powder comprising the steps of: a) mixing and heating an iron-based powder, at least one oligomer amide lubricant, and at least one fatty acid to a temperature above the melting point of the lubricant; and b) cooling the obtained mixture.

9. Method according to claim 8, wherein the mixture obtained in step a) is cooled to a temperature below the melting point of the lubricant and above the melting point of the fatty acid and thereafter a pulverulent flow agent is included in the mixture.

10. Composition according to claim 2, wherein the amount of the fatty acid is 0.015–0.15% calculated on the total weight of the powder composition.

11. Composition according to claim 1, wherein the amount of the fatty acid is 0.02–0.08% calculated on the total weight of the powder composition.

12. Composition according to claim 2, wherein the amount of the fatty acid is 0.02–0.08% calculated on the total weight of the powder composition.

13. Composition according to claim 1, wherein the amount of the fatty acid is 0.03–0.07% calculated on the total weight of the powder composition.

14. Composition according to claim 2, wherein the amount of the fatty acid is 0.03–0.07% calculated on the total weight of the powder composition.

15. Composition according to claim 1, wherein a flow agent is included in an amount from about 0.01 to about 1 percent by weight based on the total weight of the metallurgical composition and has an average particle size below about 40 nanometers.

16. Composition according to claim 1, wherein a flow agent is included in an amount from about 0.025 to about 0.5 percent by weight based on the total weight of the metallurgical composition and has an average particle size below about 40 nanometers.

* * * * *